US005413132A

United States Patent [19]

Cronan

[11] Patent Number: 5,413,132

[45] Date of Patent: May 9, 1995

[54] PARTS CLEANER WITH ROTATING CARRIAGE

[75] Inventor: Todd Cronan, Kingsville, Mo.

[73] Assignee: Aichelin-Stahl, Inc., Kingsville, Mo.

[21] Appl. No.: 152,980

[22] Filed: Nov. 15, 1993

[51] Int. Cl.[6] ..... B08B 3/04

[52] U.S. Cl. ..... 134/133; 134/141; 134/159

[58] Field of Search ..... 134/133, 134, 141, 157, 134/158, 159; 68/210

[56] References Cited

U.S. PATENT DOCUMENTS

| | | | |
|---|---|---|---|
| 404,141 | 5/1889 | Willcox | 134/159 |
| 841,299 | 1/1907 | Young | 134/159 X |
| 2,830,605 | 4/1958 | Kleeman et al. | 134/159 X |
| 3,952,756 | 4/1976 | Sheppard | 134/159 X |
| 4,370,992 | 1/1983 | Choudhury et al. | 134/134 X |
| 5,299,587 | 4/1994 | Randall et al. | 134/159 X |

FOREIGN PATENT DOCUMENTS

| | | | |
|---|---|---|---|
| 1077658 | 5/1954 | France | 134/159 |
| 1510144 | 12/1967 | France | 134/133 |

*Primary Examiner*—Philip R. Coe

*Attorney, Agent, or Firm*—Kokjer, Kircher, Bowman & Johnson

[57] ABSTRACT

A parts cleaning system for cleaning workpieces includes a washer drum for receiving a rotating parts carriage. The rotating carriage includes a self-contained gear assembly and retains multiple baskets that are rotated during cleaning. The system further includes a lifting table for raising the rotating carriage to a level at which it is loaded into the washer drum and for lowering the rotating carriage to a level at which it is ergonomically correct for an operator to load baskets containing parts. The system further includes a basket exchanging table having a charging cylinder therein for inserting the rotating carriage into and removing it from the washer drum, The charging cylinder is attached to a smaller coupling cylinder for connecting and disconnecting a flared head on the ram of the charging cylinder to the rotating carriage.

15 Claims, 4 Drawing Sheets

PARTS CLEANER WITH ROTATING CARRIAGE

BACKGROUND OF THE INVENTION

1. Field of the Invention

The present invention relates in general to a parts cleaner, in which workpieces are carried within baskets mounted on a rotating framework and submersed in cleaning fluid.

2. Description of the Related Art

Systems have been proposed for treating or washing workpieces with a fluid, in particular for cleaning and/or rinsing metallic workpieces that are being processed through complex heat treatment installations. These heat treatment installations may include, for example, vacuum heat treatment furnaces, push-through-furnaces, roller hearth furnaces, vertical retort furnaces or multi-purpose chamber furnaces. These furnaces perform blank annealing heat treatment and various other annealing processes. The furnaces also perform hardening processes and diffusion processes, such as nitriding, nitrocarburization, carbonitriding and carburization.

Prior to heat treatment, the workpiece must be thoroughly cleaned. Such precleaning is of particular importance after the workpiece has been machined, such as with a forge, a lathe, a mill or grinder. During machining, the workpiece becomes shrouded in foreign matter such as cooling lubricant, grease, lapping pastes, pigments, hardening oils, dusts and metal fragments. This foreign matter must be removed entirely before the surface of the workpiece may be treated by the above-noted heating processes. For instance, during the hardening process, nitrogen and/or carbon penetrate the workpiece surface through diffusion. However, foreign matter on the workpiece surface retards or prevents the diffusion process. Consequently, the resulting workpiece is not hardened or only partially hardened in regions covered with the foreign matter.

To avoid this problem, systems have been proposed for cleaning the workpiece once it has been machined but before its surface is treated. Often the workpiece includes a very complex contour with multiple recesses, grooves and the like, which are very difficult to clean entirely. To ensure that the workpiece is adequately cleaned, conventional cleaning systems have utilized cleaning solvents that are quite harsh and damaging to the environment. More recently, cleaning systems have been developed to be environmentally safe, by utilizing environmental sound cleaning fluids, such as soapy water. However, in order to clean the recesses, grooves, and the like sufficiently with these cleaning fluids, the environmentally sound cleaning systems must introduce the cleaning fluid with great force.

Alternatively, cleaning systems have been proposed that use a washing vessel filled with an immersion bath substantially covering the workpiece and having a temperature between 50° C. and 90° C. Once the washing vessel is closed, it is evacuated to obtain a vacuumous chamber having a pressure below the saturation vapor pressure of the cleaning fluid. This reduction in pressure causes the cleaning fluid to boil. The vacuum and boiling effect are maintained for a desired period of time until the workpiece is cleaned, after which the pressure is relieved, the cleaning fluid is discharged and the workpiece is removed. To achieve a vacuum chamber and to retain the boiling cleaner fluid, the washing vessel is sealed once the workpiece is loaded therein.

Further, it is desirable to clean as many workpieces in each wash cycle as possible. In keeping with this goal, one conventional parts cleaner has been introduced, in Europe, that includes a washing vessel which receives a parts tumbler. The parts tumbler includes a rotisserie-like construction with a central framework rotated about its axis on two trunnions in a bearing arrangement. The rotisserie includes two baskets fastened to opposite ends of the central rotating framework distal-proximate from one another. The baskets loosely contain the workpieces such that the pieces constantly tumble as the framework rotates, thus the name "parts tumbler". One end of the parts tumbler includes a drive shaft extending along the axis of rotation and outward from the baskets. The shaft is removably fastened at one end, through a coupling, to the framework and securely fastened at an opposite end to a cog or a sprocket which engages a driving mechanism. The drive mechanism induces rotation of the sprocket and the shaft and, ultimately, of the framework and the baskets. During operation, the tumbler must be removed from the vessel to load and unload the parts baskets. Once the parts are loaded within the baskets and the tumbler is loaded within the vessel, the washing chamber is sealed, flooded with cleaning fluid and evacuated until the cleaning fluid begins to boil. During cleaning, the tumbler is rotated by the driving mechanism.

However, in this conventional parts cleaner, the drive mechanism must remain isolated from the cleaning fluid, and thus outside the washing vessel. Accordingly, the driving mechanism and sprocket were positioned outside the vessel, with the shaft extending through a wall of the vessel. A water-tight seal was required between the vessel wall and the point at which the shaft extended therethrough, to prevent leakage of cleaning fluid during operation and to enable decompression of the vessel. To maintain this water-tight seal, the tumbler was formed with a coupling between the drive shaft and the framework thereby rendering the tumbler separable from the driving mechanism each time the tumbler was removed from the vessel to empty the parts baskets. This coupling assembly hindered removal of the tumbler from the vessel. Also, once the tumbler was removed from the vessel, it was unable to rotate the tumbler since the driving mechanism had been disconnected.

The need remains in the parts cleaning industry for improved design and operating techniques to address the problems and drawbacks heretofore experienced. The primary objective of this invention is to meet this need.

SUMMARY OF THE INVENTION

An object of the present invention is to provide a parts cleaner having a rotating carriage assembly that is rotatable inside and outside the vessel.

Another object of the present invention is to provide a rotating carriage assembly that is generic and is useful within most conventional parts cleaner vessels by eliminating the need for a specific drive coupling between the rotating carriage and the drive mechanism through the wall of the washer drum.

Another object of the present invention is to provide a self-contained drive mechanism and rotating carriage that is able to rotate parts independently of the washer drum.

Another object of the invention is to provide a table assembly outside the washer drum to facilitate loading and unloading of baskets into the rotating carriage and inserting and removing the rotating carriage from the washer drum.

These and other objects are achieved by a parts cleaning system having a washer drum for receiving a rotating parts carriage. The rotating carriage includes a self-contained gear and drive assembly and retains multiple baskets that are rotated during cleaning. The system further includes a lifting table for raising the rotating carriage to a level at which it is loaded into the washer drum and for lowering the rotating carriage to a level at which it is ergonomically correct for an operator to load baskets containing parts. The system further includes a basket exchanging table having a charging cylinder therein for inserting the rotating carriage into and removing it from the washer drum. The charging cylinder is attached to a smaller coupling cylinder or solenoid for connecting and disconnecting a flared head on the ram of the charging cylinder to the rotating carriage.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
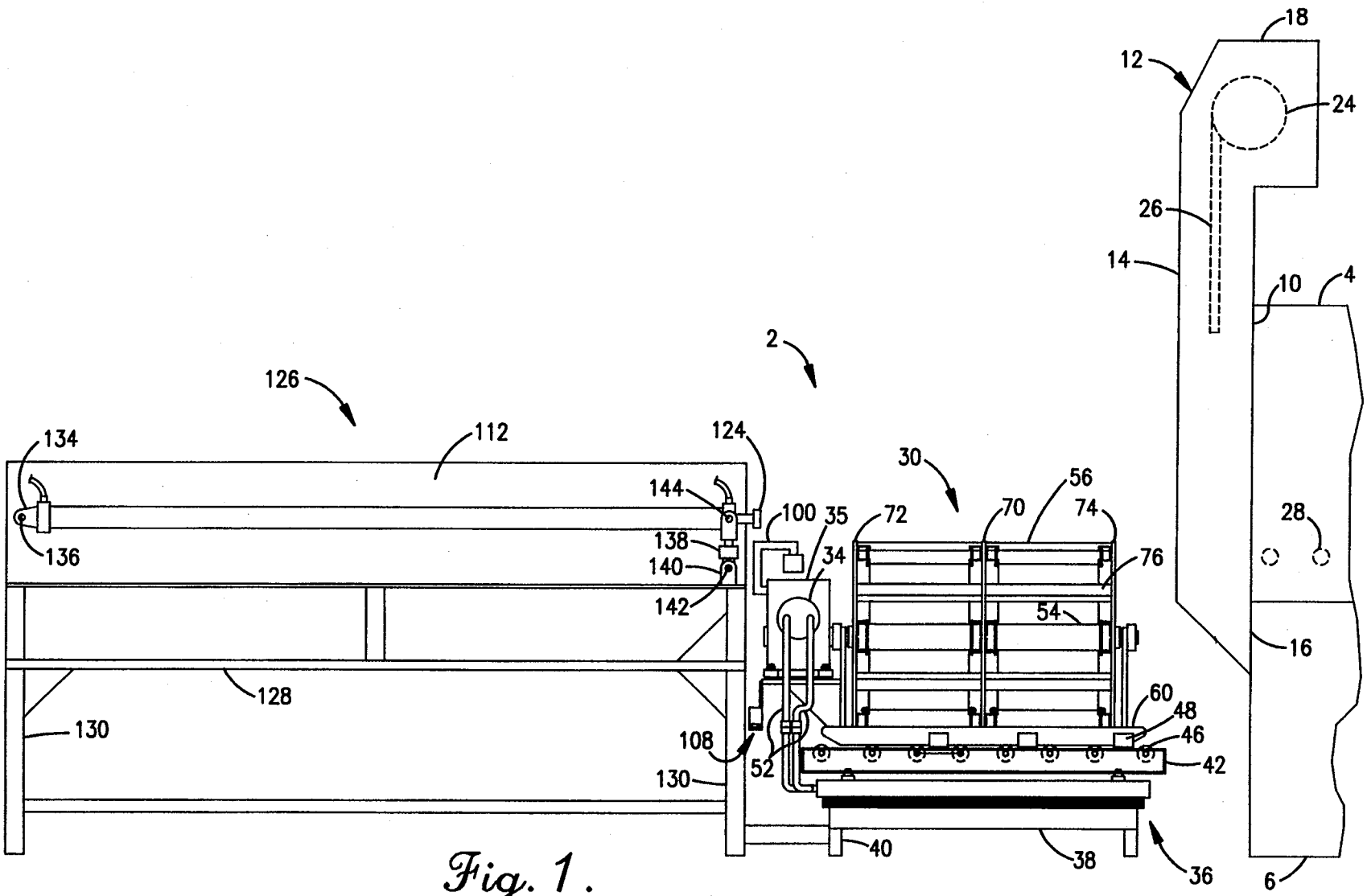
FIG. 1 is a side elevational view of a parts cleaning system according to the present invention.
Figures 5, 6:
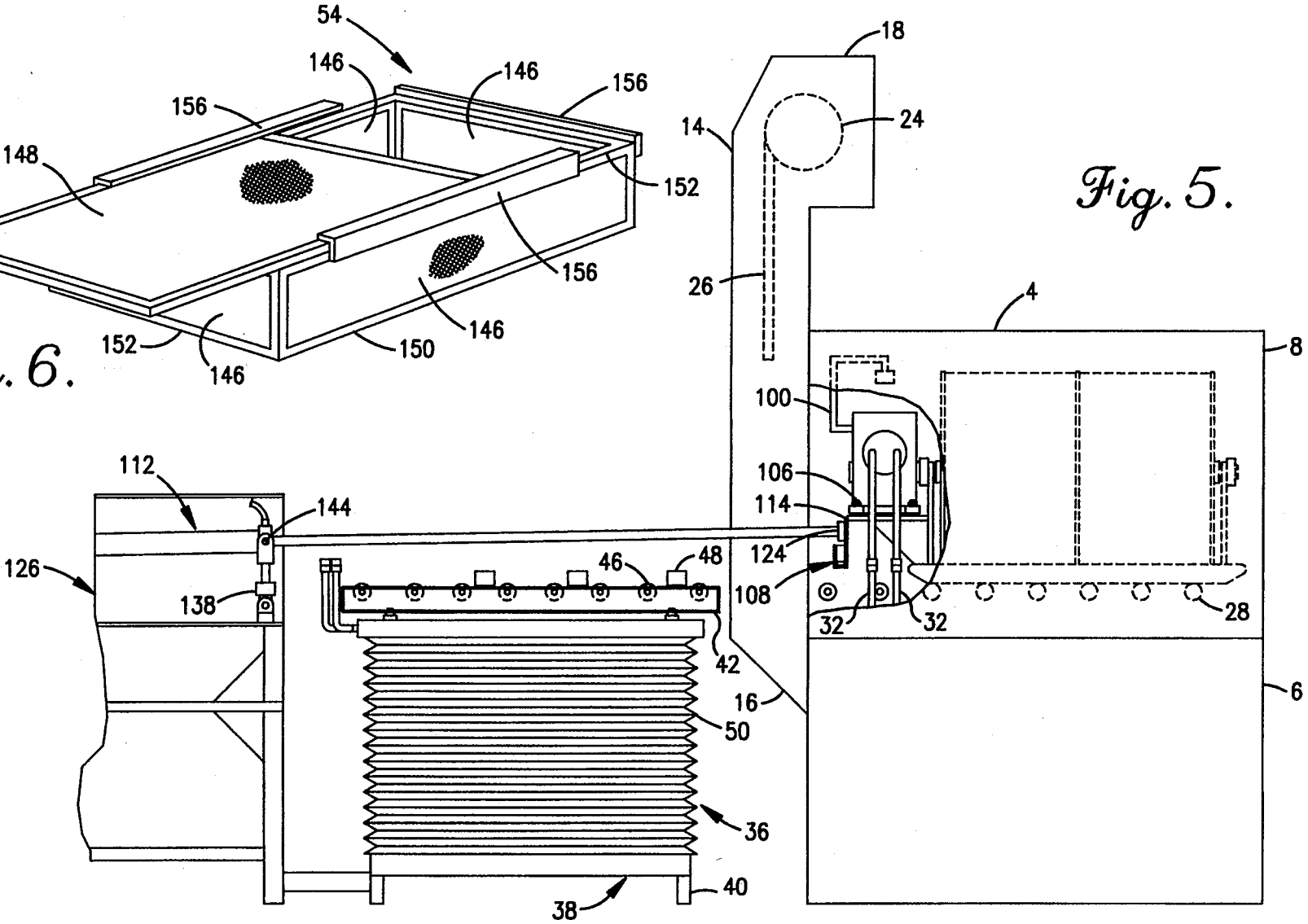
FIG. 5 is a side elevational view of the invention showing the charging and coupling cylinders according to the present invention.
FIG. 6 is a perspective view of a basket according to the present invention.

Referring now to the drawings in greater detail, FIGS. 1 and 5 illustrate a parts cleaner system according to the present invention generally designated by the numeral 2. The parts cleaner system 2 includes a tubular shaped washer drum 4 for cleaning workpieces. The washer drum 4 is oriented on its side and aligned along a horizontal axis and is supported by a rectangular base 6. The washer drum 4 includes a back end 8 that is sealed shut and an open front end 10 bordering against a door frame 12. The door frame 12 includes vertical beams 14 extending above the washer drum 4. The beams 14 are mounted at lower ends 16 to the base 6 to support the door frame 12 and at upper ends 18 to a cross-beam structure. The beams 14 include tracks which slidingly receive a door carrier 24 mounted to the door 26. The cross-beam structure is fastened to, and supports the door 26, at all times through any one of several conventional manners, such as chains or cables. The cross-beam structure supports a motor (not shown) fastened to the chains or cables to raise and lower the door 26.

As illustrated in FIG. 1, the cross-beam structure retains the door 26 in a raised position to open the washer drum 4. As the door 26 is raised and lowered, it travels along the tracks in the vertical beams 14. When closed, the door 26 forms a seal with the rim of the washer drum 4 to prevent leakage of the cleaning fluid. Within the washer drum 4, the floor includes a plurality of rollers 28 aligned side-by-side, each roller 28 rotating about an axis that is traverse to the longitudinal axis of the washer drum 4. The rollers 4 allow a rotating carriage 30 to be introduced into, and removed from, the washer drum 4 with relative ease. The washer drum 4 further includes two air lines 32 sealingly inserted through the side thereof. Both air lines 32 include quick-couplers on the ends thereof to supply air to a pneumatic motor 34 which rotates the rotating carriage 30. One air line represents an air intake, while a second air line represents an air exhaust.

A scissor lifting table 36 is positioned immediately adjacent the open/front end 10 of the washer drum 4 and the vertical beams 14. The scissor lifting table 36 supports the rotating carriage 30 and is constructed to move vertically between upper and lower positions. When in the upper position, the top of the lifting table 36 is aligned substantially with the floor of the washer drum 4. When in the lower position, the top of the lifting table 36 is at a level sufficiently low to afford an operator access to the rotating carriage 30 without reaching up or bending over.

Figure 2:
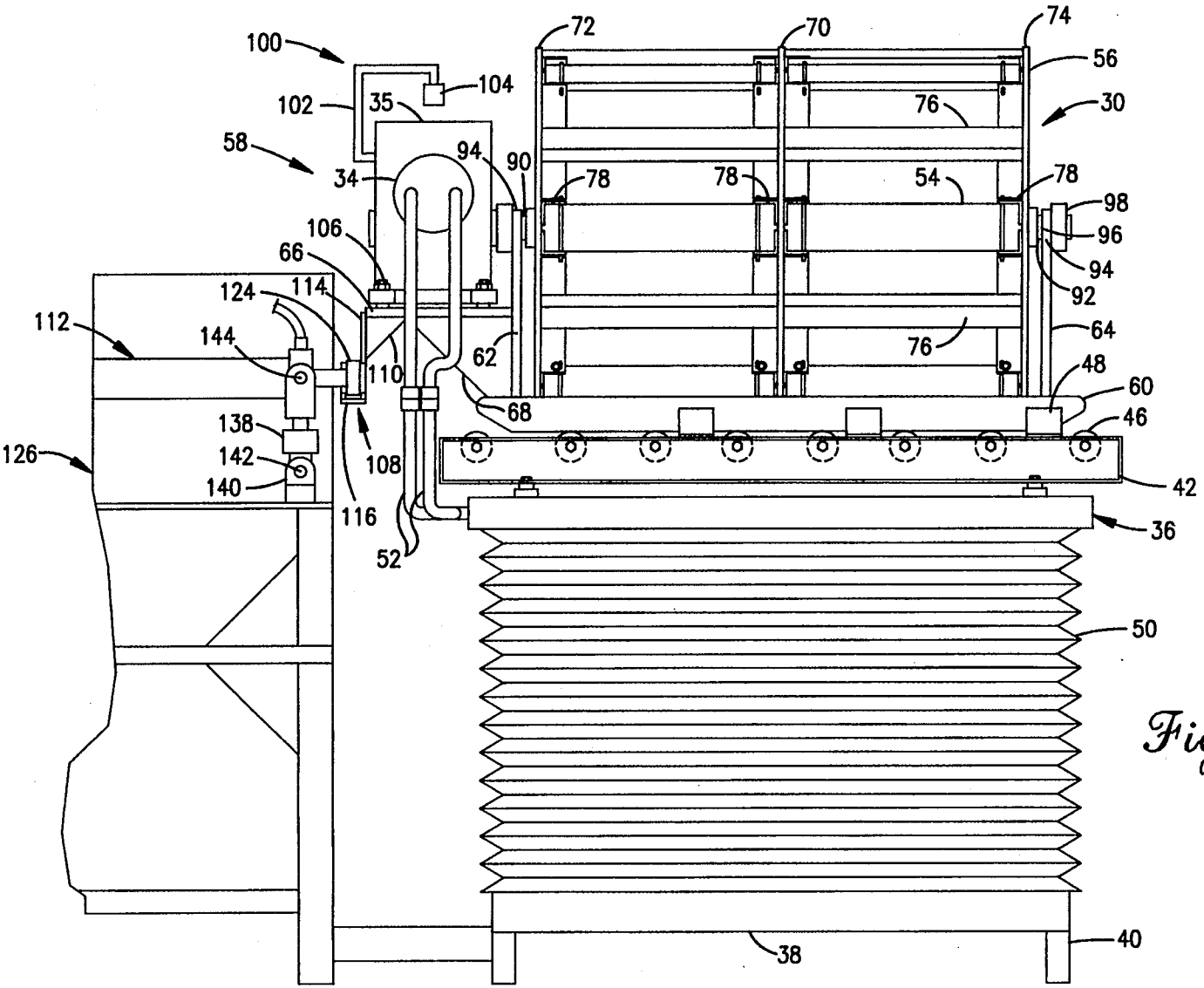
FIG. 2 is a side elevational view of a rotating carriage according to the present invention.

Referring to FIG. 2, the lifting table 36 includes a rectangular base 38 having legs 40 extending downward therefrom. A top 42 of the lifting table 36 is formed from a rectangular outer shell suspending multiple rollers 46 therein that are aligned side-by-side. The rollers 46 extend between, and are rotatably mounted to, opposite sides of the outer shell 44, in order to support and facilitate loading and unloading of the rotating carriage 30. Guide posts 48 are mounted on opposite sides of the outer shell to direct the rotating carriage 30 therebetween as it is loaded and unloaded. Optionally, the guide posts 48 may include anti-resistive means on the inner sides thereof. The top 42 and base 38 of the lifting table 36 are interconnected with a scissor-shaped truss framework (not shown) that is enclosed within a protective bellows cover 50. The truss framework includes upper and lower ends that are pivotally mounted to the top 42 and base 38 of the lifting table 36. The truss framework includes a drive assembly attached thereto which causes the truss framework to contract and expand, like scissors, thereby raising and lowering the lifting table 36. The drive assembly is switch actuated by the operator to control movement of the lifting table 36.

The lifting table 36 also includes two air lines 52 attached to a side thereof to supply air to the pneumatic motor to rotate the rotating carriage 30 when it is outside the washer drum 4. These air lines 52 include quick-couplers on the ends thereof to facilitate connection to the pneumatic motor 34 once the rotating carriage 30 has been removed from the washer drum 4. The air lines 52 include an inlet air line and an exhaust air line.

Figure 3:
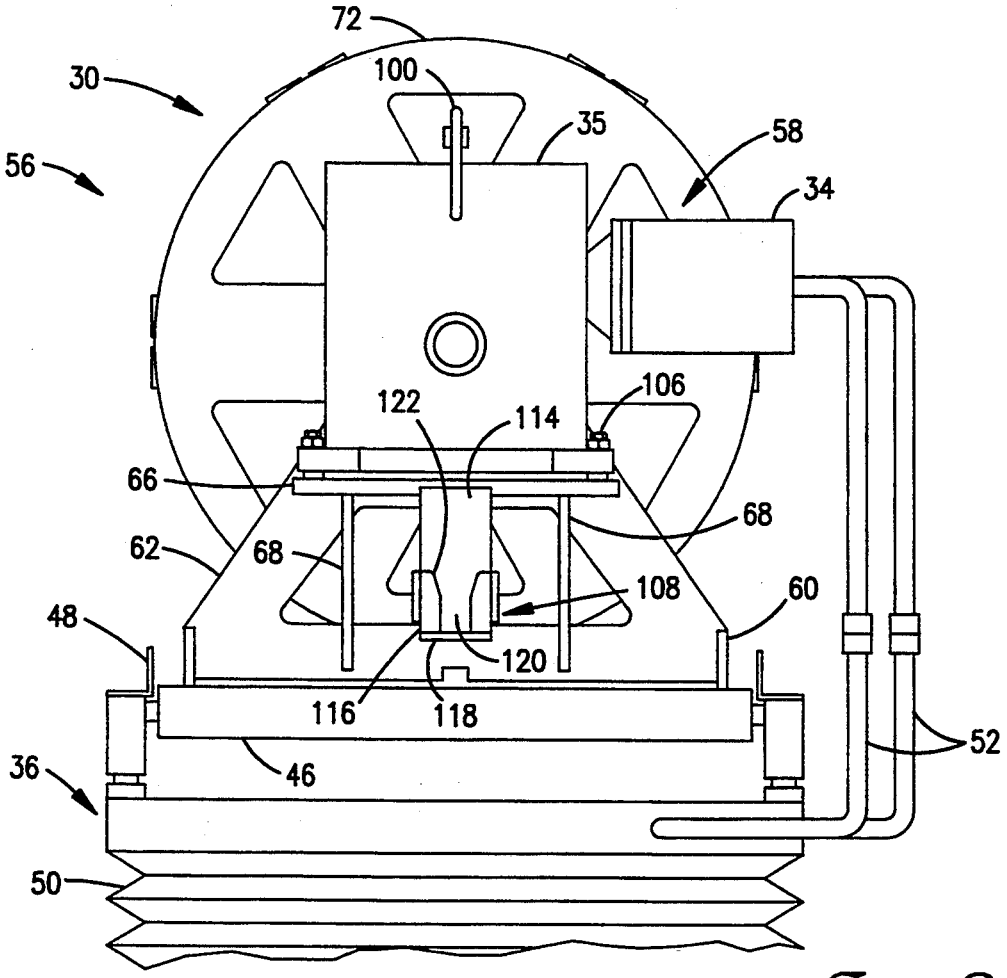
FIG. 3 is an end elevational view of the rotating carriage according to the present invention.

Referring to FIG. 3, the rotating carriage 30 holds multiple baskets within the washer drum 4 during washing, each basket 54 contains one or more parts to be cleaned. The rotating carriage 30 includes a drum-shaped framework 56 that is attached to, and rotated by a driving assembly 58. The drum-shaped framework 56 and driving assembly 58 are both supported by a base 60 formed from a rectangular frame and integral with lead and tail A-framed support brackets 62 and 64 on opposite ends thereof. A lead support bracket 62 further supports a platform 66 on an outer side thereof and extending outward therefrom. The platform 66 supports the driving assembly 58. Two primary diagonal braces 68 extend between the lead support bracket 62 and the platform 66 to support the weight of the driving assembly 58.

As illustrated in FIGS. 1 and 3, the drum-shaped framework 56 includes a central plate 70, along with lead and tail end plates 72 and 74, all of which are circular and arranged to rotate along a common longitudinal axis. The central, lead and tail plates 70, 72 and 74 include voids therethrough to minimize the necessary material. The plates 70, 72 and 74 are fixedly secured to one another with cross beams 76 dispersed evenly about a periphery of each plate and extending parallel to the longitudinal axis. The plates 70, 72 and 74 are interconnected, such as through welding, with the cross beams 76 to retain the drum shape.

Figure 4:
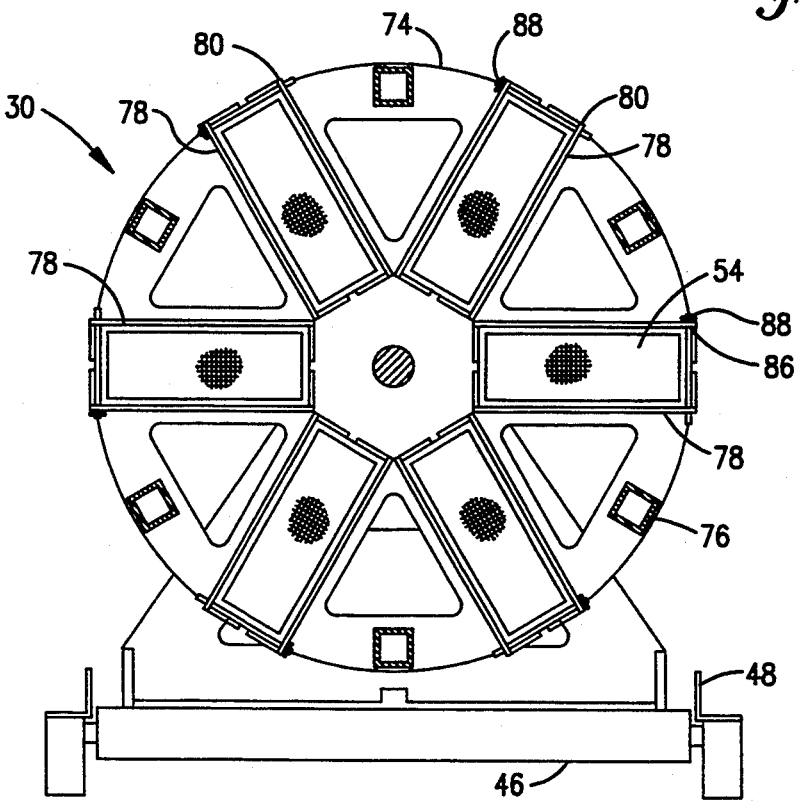
FIG. 4 is a sectional view of the rotating carriage according to the present invention.

As illustrated in FIGS. 3 and 4, the lead and tail end plates 72 and 74 include basket support channels 78 mounted on inner sides thereof for slidingly receiving the baskets 54. The central plate 70 includes basket support channels 78 on both sides thereof. The support channels 78 are arranged upon each plate in a radial pattern, such that two support channels 78 on each plate meet proximate the center of the plate along the diameter thereof. Each support channel 78 on the center plate 70 aligns with a corresponding support channel 78 on the lead and tail end plates 72 and 74, thereby forming support channel pairs that receive opposite sides of each basket 54.

Each support channel 78 may be formed from a single channel-shaped piece of metal or, alternatively, from two L-shaped pieces of metal arranged parallel and in facing relation to one another. Each channel 78 includes an outer end 80 proximate the perimeter of each plate and an inner end 82 proximate the center of each plate. The inner ends 82 include flanges 84 blocking the inner end of the channel 78 to prevent a basket 54 from sliding radially inward past a desired point and beyond the channel. The outer ends 80 of each support channel 78 include holes 86 which receive retaining pins 88 to prevent a basket 54 from falling out once inserted into the support channel pair while the framework 56 rotates. The channels 78 may be fastened to the plates 70, 72 and 74 through spot welding, bolting or the like.

The lead and tail end plates 72 and 74 include holes located along the longitudinal axis of the drum framework 56. The holes in the lead and tail end plates 72 and 74 have a diameter sufficient to receive lead and tail support shafts 90 and 92, respectively, which project outward from the drum framework 56. The lead and tail shafts 90 and 92 extend through the holes and are secured thereto in any conventional manner, such as by press fitting the shafts into the holes. The outer portions of the lead and tail shafts 90 and 92 extend through, and are rotatably supported within, bushings 94 mounted in cradles 96 at the apex of the A-framed support brackets 62 and 64. The bushings 94, which minimize the frictional resistance between the cradles 96 and the shafts 90 and 92, are made of an ultra-high molecular weight polyethylene material which is water proof and requires no lubrication. The ends of the bushings 94 receive socket end cap screws 98 to fasten the bushings 94 to the cradles 96. The lead shaft 90 extends beyond the bushing 94 and end cap screw 96 to engage securely the driving assembly 58.

As illustrated in FIG. 2, the drive assembly 58 transfers rotational force to the rotating carriage 30. The drive assembly 58 includes a motor 34 coupled to a gear box 35, both of which are mounted on and supported by the platform 66. The motor 34 and the gear box 35 are water-proof in order to operate properly when submerged in the cleaning fluid within the washer drum 4. The gear box 35 functions as a step down gear box, for instance in a 20-to-1 ratio, to increase the torque of the while reducing the rotating speed of the rotating carriage 30. With regard to the gearing mechanism, the gear box 35 resembles any conventional gear box, and thus is not explained in detail.

However, unique to the invention, the gear box 35 includes bearing seals sufficiently strong to remain water tight when submersed in cleaning fluid. Also, the gear box 35 includes a check valve 100 having a tubular section 102 with one end inserted within the operating cavity of the gear box 35. An opposite end of the tubular section 102 includes a pressure relief valve 104 to release excess air pressure from the operating cavity when the gears generate excess heat. This check valve 104 allows the gear box 35 to "breath" without allowing water into the operating cavity.

The gear box 35 includes a discharge end that is connected to the lead shaft 90 and an inlet end that is connected to the motor 34. The motor 34 represents a pneumatically driven motor that operates within a sealed water-tight chamber. The gear box 35 and motor 34 are fastened to the platform 66 with adjustable bolts 106 that are used to place the discharge end of the gear box 35 in proper alignment with the lead shaft 90. Hex headed screw caps are used to lock the adjustable bolt in position.

Referring to FIG. 3, the platform 66 includes a pocket weldment 108 centrally located on the outer edge of, and extending downward from, the platform 66. The pocket weldment 108 is supported on its backside by a secondary diagonal brace 110 positioned between the primary diagonal braces 68. The secondary diagonal brace 110 interconnects the bottom of the platform 66 and the backside of the pocket weldment 108 to resist horizontal forces applied thereto by a charging cylinder 112 (as explained below). The pocket weldment 108 includes a flat backside 114 extending downward from the shoulder of the platform 66 to a cup-shaped bottom portion 116. This cup-shaped portion 116 includes an outer lip 118 which projects upward and is split vertically along its central axis to form a U-shaped key-slot 120 with a flared upper tip 122. This key-slot 120 releasably receives a flared head 124 on the outer end of the charging cylinder 112 to facilitate loading and unloading of the rotating carriage 30 from the washer drum 4.

Again referring to FIG. 1, the cleaning system also includes a basket exchanging table 126 having a rectangular shaped work bench 128 that is supported by legs 130. The work bench 128 is located at a height convenient for an operator to empty and load parts into the baskets 54. Two of the legs 130 are connected through linking beams to the base of the lifting table 36 to maintain a preset fixed distance between the lifting table 36 and the basket exchanging table 126. The work bench 128 is divided in half by a partition 132 extending the length of the work bench 128 and having front and rear vertical supports. The partition 132 further includes a lower horizontal support spanning the front and rear vertical supports. The partition 132 is rigidly fastened to the work bench 128 and the legs 130 through braces at opposite ends and in the center thereof. The partition 132 internally houses a charging cylinder 112 arranged in a substantially horizontal position and extending throughout a length of the partition 132.

The charging cylinder 112 includes a jacket with a base end formed into a coupling 134 that is pivotally mounted through a pin 136 to the rear vertical support bracket of the partition 132. The front end of the jacket slidingly receives a ram extending therefrom in a horizontal direction. The ram including a flared head 124 on its outer end which is releasably mounted in the cup-shaped bottom portion 116 of the pocket weldment 108. More directly, the ram is formed with a diameter smaller that the width of the key-slot 120 in the front lip 118 of the pocket weldment 108, while the flared head 124 is formed with a diameter much greater that the width of the key-slot 120. Thus, the pocket weldment 108 is formed to receive the flared head 124 while the key-slot 120 is formed to receive the ram itself.

The front end of the jacket is pivotally joined to a small coupling cylinder or solenoid 138 positioned below the charging cylinder 112 and aligned in a vertical direction. The coupling cylinder 138 includes a jacket having a base 140 fastened through a pin 142 to the horizontal support bracket within the partition 132. The coupling cylinder 138 includes a piston having an outer end that is attached, via a pin 144 to the bottom of the front end of the jacket of the charging cylinder 112. Thus, when the coupling cylinder 138 extends, it causes the charging cylinder 112 to pivot in an upward arcuate path about the pin 136, thereby raising the front end of the ram and the flared head 124. Similarly, when the coupling cylinder 138 contracts, it causes the charging cylinder 112 to pivot in a downward arcuate path about the pin 136, thereby lower the front end of the ram and the flared head 124. The basket exchanging table 126 includes switches and for actuating the charging and coupling cylinders 112 and 138, respectively.

As illustrated in FIG. 6, the baskets 54 are formed as rectangular boxes with stainless steel screen sides 146, lid 148 and floor 150, all of which are mounted within a stainless steel framework. The top border 152 of the framework includes a C-shaped passage 154 around three sides thereof, while the lid 148 includes a flange 156 about its perimeter. The flange 156 is slidingly received within C-shaped passage 154 to close the basket and hold the lid 148 in place.

During operation, a set of empty baskets 54 (i.e., 12 baskets in the preferred embodiment) are positioned on the work bench 128 with the lids 148 removed. Each basket is completely filled with parts, such that once the lid 148 is slid into place, the parts are unable to move or tumble within the basket as it is rotated. After filling the baskets, they are loaded into the rotating carriage 30. Specifically, each basket 54 is slidably inserted into a corresponding channel pair 78 and pins 88 are inserted to retain the baskets within the channels 78 as the carriage 30 rotates.

Prior to loading the baskets 54, the rotating carriage 30 is positioned on the lifting table 36, in a manner explained below, and the two air lines, attached to the lifting table, are connected to the pneumatic motor. The height of the lifting table 36 is modified by adjusting the scissors-shaped truss such that an empty channel pair 78 is located at an ergonomically correct height for loading by the operator. The operator inserts baskets into the two or four channels 78 located immediately adjacent and directly exposed to the operator and inserts the pins 88 behind the baskets 54. Next, the operator actuates a switch supplying air to the pneumatic motor, thereby causing the driving assembly 58 to rotate the carriage 30 a few degrees and expose an empty channel pair 78. The operator repeats this process until all twelve baskets are loaded.

Then, the lifting table 36 is actuated to raise the rotating carriage 30 to a height at which the carriage may be loaded into the washing drum 4, namely where the rollers 46 of the lifting table 36 align with the rollers 28 on the floor the washer drum 4. Hoisting the rotating carriage 30 also causes the pocket weldment 108 to raise, such that the cup-shaped bottom portion of the pocket weldment 108 receives the flared head 124 of the ram. This alignment is protected by using the linking members between the lifting table and the basket exchanging table 126 to maintain a constant distance therebetween. Once the pocket weldment 108 is lifted to receive the flared head 124, the rotating carriage 30 is securely fixed to the charging cylinder 112.

Optionally, if the pocket weldment 108 does not receive the flared head 124 after raising the lifting table 36, the charging and coupling cylinders may be used to achieve this connection. Specifically, once the lifting table 36 is at a desired height, the operator may attaches the charging cylinder 112 to the rotating carriage 30, by actuating a coupling cylinder switch to extend the coupling cylinder 138. This motion causes the coupling cylinder to raise the front end of the charging cylinder, thereby lifting the flared head 124 on the ram to a position above the key-slot 120. Next, a charging cylinder switch is actuated to extend the charging cylinder 112 slightly forward until the flared head 124 is extended beyond the key-slot 120 and is positioned immediately above the cup-shaped bottom portion 116. When in this position, the flared head 124 is immediately adjacent the upper portion of the backside of the pocket weldment 108. Next, the coupling cylinder switch is actuated to compress the coupling cylinder 138 thereby lowering the flared head 124 on the charging cylinder 112 into the cup-shaped bottom portion 116 and inserting the ram into the key-slot 120. Once lowered, the charging cylinder 112 is securely engaged with the rotating carriage 30.

Subsequently, the charging cylinder switch is actuate to cause the charging cylinder to extend, thereby pushing the rotating carriage 30 forward and into the washer drum 4. The rotating carriage 30 slides along the rollers 46 on the lifting table 36 and along the rollers 28 on the floor of the washer drum 4 in the direction of the longitudinal axis of the washer drum 4. The guide posts 48 on opposite sides of the lifting table 36 navigates the rotating carriage 30 into the washer drum 4. Once the rotating carriage 30 is placed entirely within the washer drum 4, the charging cylinder 112 is disengaged by actuating the coupling cylinder switch to cause the coupling cylinder 138 to extend. As the coupling cylinder 138 extends, the flared head 124 is shoved upward and withdrawn from the cup-shaped bottom portion 116. Next, the charging cylinder switch is actuated to cause the charging cylinder 112 to contract until the ram returns to its idle position within the jacket. Then, the coupling cylinder 138 is contracted to its idle position.

Thereafter, the air lines attached to the lifting table 36 are disconnected and the air lines in the washer drum 4 are attached to the pneumatic motor. This enables the operator to control rotation of the carriage 30 during cleaning. The door 26 is closed by operating the on the door frame 12 to lower the cross structure holding the door 26. Thereafter, the door 26 is fitted sealingly against the end of the washer drum 4, and the washer drum 4 is flooded with cleaning fluid. While cleaning the parts, the rotating carriage 30 rotates within the washer drum 4.

After the cleaning operation is complete, the door 26 is unsealed and the cross structure and the door 26 are raised to open the end of the washer drum 4. The charging and coupling cylinders 112 and 138 are operated, in the manner explained above, to attach the flared head 124 to the pocket weldment 108 on the rotating carriage 30. Once attached, the charging cylinder 112 contracts and pulls the rotating carriage 30 out of the washer drum 4 and onto the lifting table 36. The rollers in the washer drum 4 and on the lifting table 36 facilitate movement of the carriage 30 while the guide posts 48 direct the lifting table 36. Next, the lifting table 36 is lowered to a level at which the operator may easily unload the baskets 54. During this lowering operation, the pocket weldment 108 falls away from the flared head 124 on the charging cylinder 112. The baskets 54 are reloaded and the above process is repeated.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings 1–6 is to be interpreted as illustrative, and not in a limiting sense.

What is claimed is:

1. A cleaning apparatus for cleaning workpieces, said apparatus comprising:

a washer drum for washing said workpieces, said drum being formed along a longitudinal axis and having an open end arranged along said axis, said drum including a door to seal shut said open end during a washing cycle and to expose said opening during a reloading cycle;

carriage means for rotating said workpieces during said washing cycle and during said reloading cycle, said carriage means holding said workpieces within said drum during said washing cycle and releasably receiving said workpieces outside said drum during said reloading cycle;

driving means, fixedly mounted to said carriage means, for rotating said carriage means during said washing cycle and during said reloading cycle.

2. A cleaning apparatus according claim 1, further comprising a plurality of baskets for securely holding said workpieces in a fixed relation to said carriage means and for preventing said workpieces from tumbling relative to one another when rotated by said carriage means.

3. A cleaning apparatus according to claim 2, wherein said carriage means includes a drum-shaped framework attached to, and rotated by said driving means, said drum-shaped framework including at least two plates having support channels thereon for slidingly receiving said baskets.

4. A cleaning apparatus according to claim 3, wherein said support channels are arranged in a radial pattern, such that two support channels on each of said plates meet proximate a center of said plate along a diameter thereof.

5. A cleaning apparatus according to claim 2, wherein said baskets are evenly distributed about a perimeter of said carriage means.

6. A cleaning apparatus according to claim 1, wherein said driving means includes a motor mounted on said carriage means, said motor being inserted into and removed from said washing drum along with said carriage means.

7. A cleaning apparatus according to claim 6, wherein said carriage means includes a drum-shaped framework that revolves about an axis of rotation and a drive shaft fixedly secured between said drum-shaped framework and said motor.

8. A cleaning apparatus according to claim 6, further including a gear box mounted on said carriage means for transferring a rotational driving force from said motor to said carriage means, said gear box being inserted into and removed from said washing drum along with said carriage means.

9. A cleaning apparatus according to claim 1, further comprising:

charging means for inserting and removing said rotating carriage into and from said washer drum.

10. A cleaning apparatus according to claim 9, wherein said charging means includes a charging cylinder aligned horizontally along said longitudinal axis and having a flared head on a ram received within said charging cylinder, said carriage means including a pocket weldment on one end thereof proximate said open end of said washer drum, said pocket weldment slidingly receiving said flared head to attach said charging cylinder to said carriage means.

11. A cleaning apparatus according to claim 10, wherein said charging means further includes a coupling solenoid aligned in a vertical direction and attached to a front end of said charging cylinder, said coupling solenoid attaching and detaching said flared head from said pocket weldment.

12. A cleaning apparatus according to claim 1, further comprising aligning means for aligning said rotating carriage with said open end of said drum, said aligning means including a lifting table that is vertically moveable between upper and lower positions, said lifting table receiving said carriage means from said washer drum when in said upper position and allowing an operator to remove workpieces therefrom when in said lower position.

13. A rotating carriage for use within a parts cleaner having a washer drum for washing workpieces, said rotating carriage being sealed within said washer drum during a washing cycle and being removed through an open end in said washer during a reloading cycle, said carriage comprising:

a carriage for rotating said workpieces during said washing cycle and during said reloading cycle, said carriage holding said workpieces during said washing cycle and releasably receiving said workpieces during said reloading cycle, said carriage including a drive shaft;

a base for rotatably supporting said carriage; and a motor fixedly secured to said base and to said drive shaft for rotatably driving said carriage during said washing cycle and during said reloading cycle, said motor being inserted into and removed from said washer drum with said carriage.

14. A rotating carriage according to claim 13, wherein said carriage includes a drum-shaped framework having at least two circular end plates arranged to rotate along a longitudinal axis, said end plates including support channels arranged in a radial pattern to form channel pairs which receive said workpieces.

15. A rotating carriage according to claim 1, further comprising a plurality of baskets for securely holding said workpieces in a fixed relation to said carriage and for preventing said workpieces from tumbling relative to one another when rotated by said carriage.

* * * * *